US008531236B2

(12) United States Patent
Lechner et al.

(10) Patent No.: US 8,531,236 B2
(45) Date of Patent: Sep. 10, 2013

(54) CURRENT MIRROR ARRANGEMENT AND METHOD FOR SWITCHING ON A CURRENT

(75) Inventors: Franz Lechner, Kumberg (AT); Gerhard Loipold, Graz (AT)

(73) Assignee: AMS AG, Unterpremstaetten (AT)

( * ) Notice: Subject to any disclaimer, the term of this patent is extended or adjusted under 35 U.S.C. 154(b) by 536 days.

(21) Appl. No.: 12/747,161

(22) PCT Filed: Nov. 20, 2008

(86) PCT No.: PCT/EP2008/065914
§ 371 (c)(1),
(2), (4) Date: Sep. 20, 2010

(87) PCT Pub. No.: WO2009/074439
PCT Pub. Date: Jun. 18, 2009

(65) Prior Publication Data

US 2011/0199070 A1 Aug. 18, 2011

(30) Foreign Application Priority Data

Dec. 10, 2007 (DE) ..... 10 2007 059 356

(51) Int. Cl.
*G05F 1/10* (2006.01)

(52) U.S. Cl.
USPC ..... 327/543

(58) Field of Classification Search
USPC ..... 323/312, 315; 327/534, 535, 537, 327/538, 543
See application file for complete search history.

(56) References Cited

U.S. PATENT DOCUMENTS

| | | | | |
|---|---|---|---|---|
| 5,498,995 | A | 3/1996 | Szepesi et al. | |
| 5,808,460 | A * | 9/1998 | Wei et al. | 323/315 |
| 5,982,162 | A | 11/1999 | Yamauchi | |
| 6,037,811 | A | 3/2000 | Ozguc | |
| 6,177,817 | B1 | 1/2001 | Fifield et al. | |
| 6,417,708 | B1 | 7/2002 | Fiedler | |
| 7,064,696 | B2 * | 6/2006 | Ohkubo et al. | 341/136 |
| 2003/0141928 | A1 | 7/2003 | Lee | |
| 2007/0075744 | A1 | 4/2007 | Ng | |
| 2007/0121368 | A1 | 5/2007 | Gilbert | |
| 2007/0216483 | A1 | 9/2007 | Bhattacharya et al. | |

FOREIGN PATENT DOCUMENTS

| | | |
|---|---|---|
| DE | 10 2004 052 214 | 5/2006 |
| WO | WO 2006/042684 | 4/2006 |

OTHER PUBLICATIONS

Lee, C. et al.: "A 90nm 1.8V 512Mb Diode-Switch PRAM with 266MB/s Read Throughput," Solid-State Circuits Conference, 2007, ISSCC 2007, Digest of Technical Papers, IEEE International, Feb. 11-15, 2007, pp. 472, 473, 616.

Lee, C. et al.: "A 90nm 1.8V 512MB Diode-Switch PRAM with 266MB/s Read Throughput," Solid-State Circuits Conference, 2007, ISSCC 2007, Digest of Technical Papers-Visual Supplements, IEEE International, Feb. 11-15, 2007, pp. 384, 385, 721.

* cited by examiner

*Primary Examiner* — Jeffrey Zweizig
(74) *Attorney, Agent, or Firm* — McDermott Will & Emery LLP

(57) ABSTRACT

A current mirror arrangement comprises a switchable, adjustable current source (Q1, Q2) for providing an impression current (IP), a current mirror (SP) having an input (E) for feeding in an impression current (IP) and an output (A) for providing a current (I), and a step-up generator (AG) coupled to the current mirror (SP) such that the current (I) is switched on with an adjustable slew rate. In addition, a method for switching on a current is provided.

14 Claims, 3 Drawing Sheets

CURRENT MIRROR ARRANGEMENT AND METHOD FOR SWITCHING ON A CURRENT

RELATED APPLICATION

This is a U.S. National Phase Application under 35 USC §371 of International Application PCT/EP2008/065914 filed on Nov. 20, 2008.

This patent application claims the priority of German Patent Application No. 10 2007 059 356.4 filed Dec. 10, 2007, the disclosure content of which is hereby incorporated by reference.

FIELD OF THE INVENTION

The present invention relates to a current mirror arrangement and a method for switching on a current.

BACKGROUND OF THE INVENTION

A conventional arrangement of a current driver comprises a current source for providing a supply current, and a current mirror. The supply current is supplied to the input circuit of the current mirror. At the output of the current mirror, a current with an adjusted current mirror ratio relative to the supply current is provided. The switch-on behavior is influenced by parasitic effects such as parasitic capacitances, which can additionally vary due to the manufacturing process, as well as temperature and voltage dependence. In the field of such current drivers in which current mirrors are used to achieve a defined switch-on behavior, long and variable switch-on times consequently represent a problem. This problem is particularly severe for current drivers that are used in high-frequency circuits such as LED controllers. For example, a high-resolution pulse width modulation on which this application is based places special requirements on the transition behavior when a current driver is switched on.

SUMMARY OF THE INVENTION

One object of the present invention is to improve the switch-on behavior of current drivers that are based on a current mirror.

In one embodiment, a current mirror arrangement has a switchable, adjustable current source for providing an impression current, a current mirror and a step-up generator. The current mirror has an input for feeding in the impression current and an output for providing a current. The step-up generator is coupled to the current mirror in such a manner that the current is switched on with an adjustable slew rate.

The impression current is fed to the current mirror. With the aid of the step-up generator, the current is switched on with an adjustable slew rate and is provided at the output of the current mirror. In the present context, the term current source comprises the designation for current sink and/or a current source.

A defined switch-on of the current is advantageously achieved by means of the adjustable slew rate. Thereby the switch-on behavior is improved and in particular, is independent of the level of the output current.

In a refinement, the switchable, adjustable current source comprises a first current source switchable by a power-on switch for providing a supply current and a switchable, adjustable second current source switchable by an acceleration switch for providing an acceleration current. The impression current is thereby formed as a sum of the supply current and the acceleration current.

In another embodiment, the step-up generator comprises a series circuit, having a switchable third current source, a rise switch and a transistor, connected between a first terminal and a second terminal of the current mirror arrangement. A voltage can be tapped between a first and a second terminal of the transistor as a reference voltage.

The curve of the reference voltage over time specifies the time constant with which the slew rate is determined.

Thereby an adjustable switch-on behavior of the current is advantageously achieved.

In a refinement, the current mirror comprises an input and an output transistor. The input transistor is connected between the input of the current mirror and the second terminal of the current mirror arrangement. A voltage between a first and a second terminal of the input transistor forms a master reference voltage.

In another embodiment, the current mirror comprises a discharge switch that is connected between the input of the current mirror and the second terminal of the current mirror arrangement.

In a refinement, the current mirror is coupled to the step-up generator via a comparator for providing a control voltage.

In another embodiment, the control voltage provided by the comparator is formed as a function of a difference between the reference voltage and the master reference voltage.

In another embodiment, the acceleration current provided by the second current source is adjustable relative to the control voltage.

The difference between an instantaneous level of the reference voltage, which defines the slew rate, and the master reference voltage, which is a measure of the current emitted at the output during power-on, thus controls the level of the acceleration current. The latter is supplied to the current mirror in addition to the supply current. In that way, the power-on behavior is accelerated in a defined manner.

In another embodiment, the first, the second and the third current source are dimensioned such that a reference current emitted from the third current source corresponds to the supply current, and the maximum adjustable acceleration current is larger than the supply current. The acceleration current is preferably larger than the supply current by, e.g, a factor of 5 or, for example, a factor of 10.

In another embodiment, a control unit causes the current to be switched on by simultaneous closing of the power-on switch, the rise switch and the acceleration switch, and a simultaneous opening of the discharge switch.

In a refinement, the control unit causes the current to be switched off by a closing of the discharge switch and respective simultaneous opening of the power-on switch, the rise switch and the acceleration switch.

In another embodiment, the input transistor of the current mirror and the transistor of the step-up generator are dimensioned equally.

Thereby and due to the above-described dimensioning of the currents, the master reference voltage dropping at the input transistor of the current mirror and the reference voltage provided at the transistor of the step-up generator are advantageously directly comparable with respect to their respective order of magnitude.

In a refinement, the current can be adjusted with a specifiable current mirror ratio relative to the supply current.

By virtue of the fact that the slew rate is defined by the reference voltage, the switch-on behavior is advantageously independent of the level of the provided current, i.e., independent of the current mirror ratio.

In one embodiment, a method for switching on a current comprises the feeding-in of a supply current, the impression of a rising edge relative to a curve of a reference voltage and the provision of a current as a function of the supply current, and with the rising edge.

A defined switch-on behavior of the current is made possible by virtue of the fact that the rising edge is impressed relative to the curve of the reference voltage. This advantage becomes particularly clear with complementary metal oxide semiconductor (CMOS) circuits. Parasitic effects are reduced with the method.

In a refinement, the final value of the current that is achieved at power-on is adjustable with a specifiable current mirror ratio relative to the supply current.

By impressing the rising edge relative to the curve of the reference voltage, the size of the current mirror ratio does not influence the switch-on behavior.

In another embodiment, the impressed rising edge is adjustable by means of the reference voltage.

The curve of the reference voltage specifies the time constant of the rising edge to be impressed in this case.

BRIEF DESCRIPTION OF THE DRAWINGS

The invention will be described in detail below for several exemplary embodiments with reference to the figures. Components and circuit elements that are functionally identical or have the identical effect bear identical reference numbers. Insofar as circuit parts or components correspond to one another in function, a description of them will not be repeated in each of the following figures. Therein.

DETAILED DESCRIPTION OF THE DRAWINGS

Figure 1:
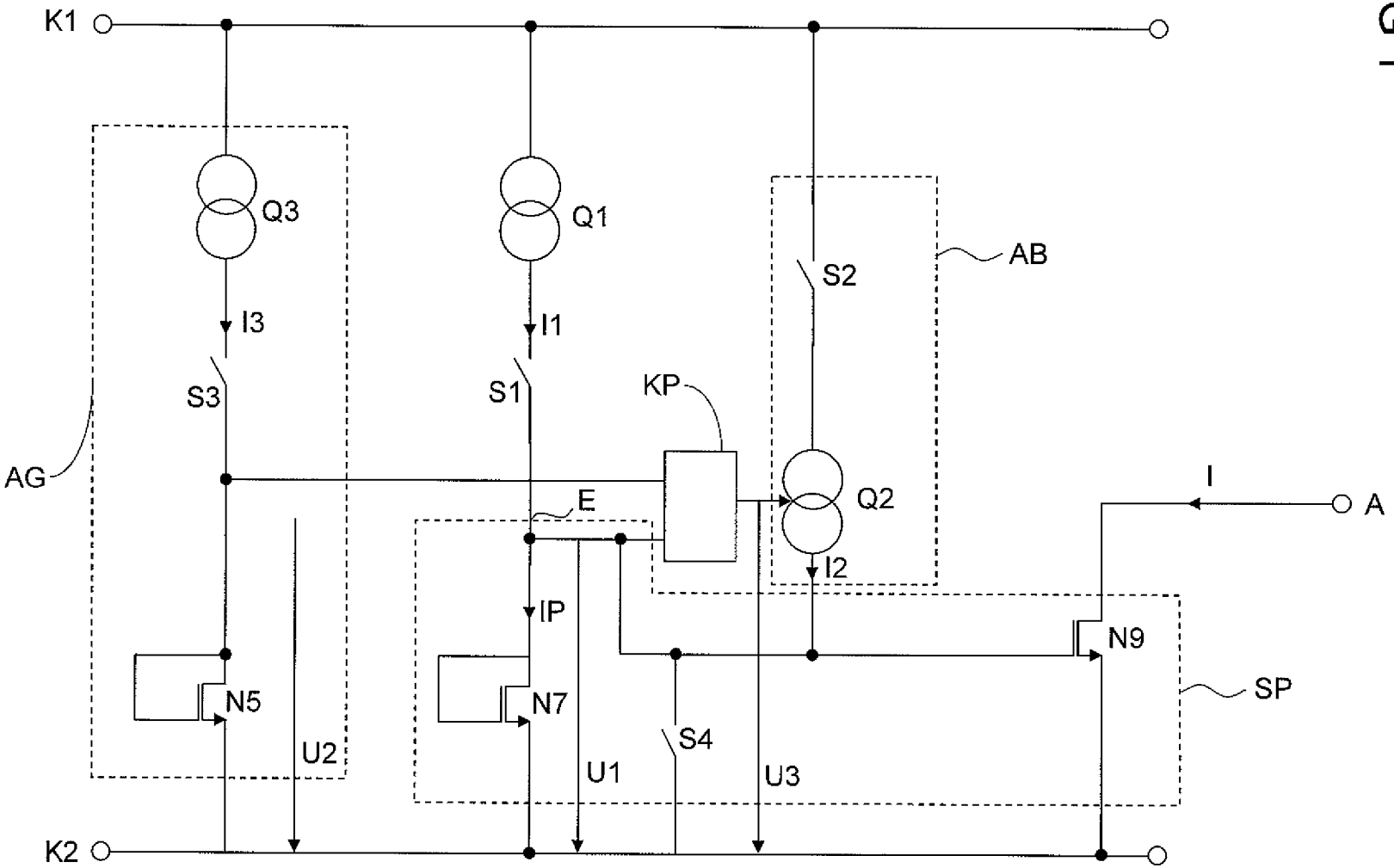
FIG. 1 shows a first exemplary embodiment of a current mirror arrangement.

FIG. 1 shows a first exemplary embodiment of a current mirror arrangement. The circuit arrangement comprises a step-up generator AG, a current mirror SP, a rise accelerator AB, a comparator KP and a switchable current source Q1. The step-up generator AG comprises a current source Q3 switchable by a rise switch S3 for providing a reference current I3, as well as an n-channel field effect transistor N5. The current source Q3 is connected on the one hand to a first terminal K1 of the current mirror arrangement and on the other to the transistor N5 via the rise switch S3. A gate and a drain terminal of the transistor N5 are connected via the rise switch S3 to the current source Q3. A source terminal of the transistor N5 is coupled to the second terminal K2 of the current mirror arrangement. A drain-source voltage of the transistor N5 forms a reference voltage U2. The current source Q1 is connected on the one hand to the first terminal K1 of the current mirror arrangement and on the other to the power-on switch S1. The current mirror SP comprises an input transistor N7 configured as an re-channel field effect transistor N7 and an output transistor N9, likewise configured as an re-channel field effect transistor, as well as a discharge switch S4. A gate terminal and a drain terminal of the input transistor N7 are connected to a gate terminal of the output transistor N9. This node constitutes an input E of the current mirror SP. A source terminal of the input transistor N7, as well as a source terminal of the output transistor N9 are connected to the second terminal K2 of the current mirror arrangement. A drain-source voltage of the input transistor N7 forms a master reference voltage U1. The discharge switch S4 is connected between the input E of the current mirror SP and the second terminal K2 of the current mirror arrangement. A drain terminal of the output transistor N9 forms an output A of the current mirror arrangement at which a current I is provided. The rise accelerator AB comprises a voltage-controlled current source Q2 switched by an acceleration switch S2. The voltage-controlled current source Q2 is connected on the one hand via the acceleration switch S2 to the first terminal K1 of the current mirror arrangement and on the other to the input E of the current mirror SP. The comparator KP has a first input for supplying the reference voltage U2, a second input for supplying the master reference voltage U1 and an output for providing the control voltage U3.

The dimensioning of the currents is as follows: the reference current I3 is exactly as large as the supply current I1, and the acceleration current I2 is larger than the supply current I1. The acceleration current I2 is preferably larger than the supply current I1 by a factor of five or a factor of ten. The input transistor N7 of the current mirror SP is dimensioned exactly as large as the transistor N5 of the step-up generator AG. A sum of the supply current I1 and the acceleration current I2 forms an impression current IP that is fed to the input E of the current mirror SP.

The supply current I1, the reference current I3 and the acceleration current I2 are switched on by simultaneous closure of the power-on switch S1, the rise switch S3 and the acceleration switch S2. The discharge switch S4 is simultaneously opened. The reference voltage U2 dropping at the transistor N5 begins to increase. The master reference voltage U1 dropping at the input transistor N7 likewise begins to increase. Because the transistors N5 and N7 are dimensioned equally, the voltages dropping at them are directly comparable with regard to their respective order of magnitude. The master reference voltage U1 dropping at the input transistor N7 rises more slowly than the reference voltage U2 due to the higher load. The comparator KP forms the difference of the reference voltage U2 and the master reference voltage U1 and provides it at its output as a control voltage U3. The control voltage U3 determines the level of the acceleration current I2 emitted by the voltage-controlled current source Q2. The acceleration current I2 is additionally fed to the input E of the current mirror SP, and thus accelerates the rise of the current I provided at the output A. Shortly before the final value of the current I determined by a specifiable current mirror ratio is reached, the acceleration current I2 is switched off.

The slew rate during provision of the current I is advantageously determined by a curve of the reference voltage U2 derived from the reference current I3. The curve of the reference voltage U2 is determined by a conductance of the rise switch S3, as well as by a switch-on behavior of the transistor N5. The slew rate is thus independent of the size of the provided current I, i.e., independent of a current mirror ratio realized in the current mirror SP. Thereby a defined switch-on behavior is achieved.

Figure 2:
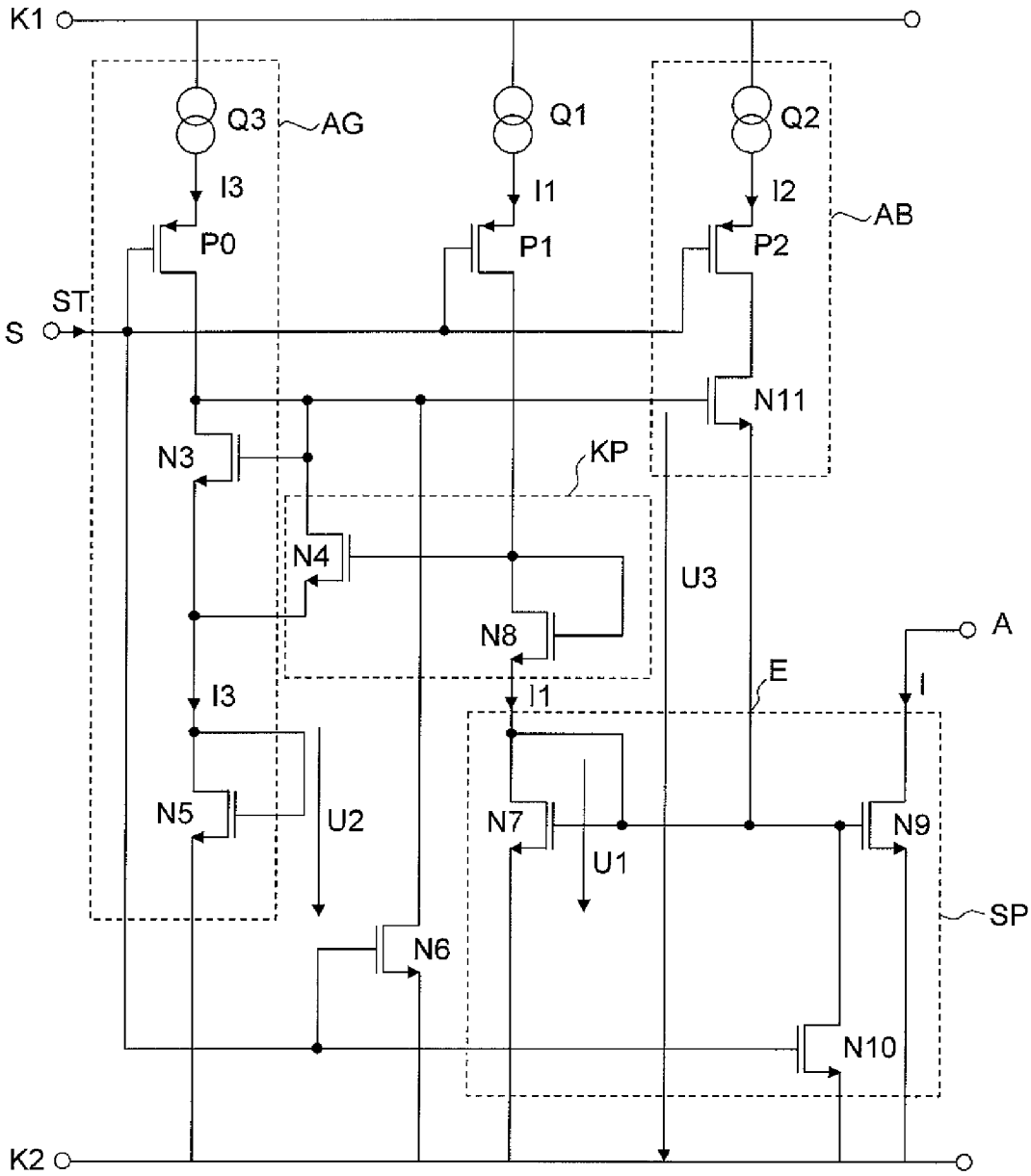
FIG. 2 shows an additional exemplary embodiment of a current mirror arrangement.

FIG. 2 shows another exemplary embodiment of a current mirror arrangement. In addition to the circuit shown in FIG. 1, the circuit of FIG. 2 comprises a control input S at which a control signal ST is supplied, as well as an n-channel field effect transistor N6 operated as a switch. The first terminal K1 of the circuit arrangement here carries, for example, a supply potential, and the second terminal K2 of the circuit arrangement is at reference potential, for example, ground potential. The step-up generator AG comprises, in addition to that of FIG. 1, a p-channel field effect transistor P0 and an n-channel field effect transistor N3. The transistor P0 is an embodiment of the rise switch S3 from FIG. 1. A gate terminal of the transistor P0 is connected to the control input S, a source terminal of the transistor P0 is connected to the current source Q3, and a drain terminal of the transistor P0 is connected to a drain terminal and a gate terminal of the transistor N3. A source terminal of the transistor N3 is coupled to the gate terminal and the drain terminal of the transistor N5. The transistor N3 is operated as a diode. The reference voltage U2 is again provided as the drain-source voltage of the transistor N5. A p-channel field effect transistor P1 realizes the power-on switch S1 from FIG. 1. A gate terminal of the transistor P1 is connected to the control input S. A source terminal of the transistor P1 is connected to the current source Q1, a drain terminal of the transistor P1 is coupled via an n-channel field effect transistor N8 to the input E of the current mirror SP. The comparator KP comprises two n-channel field effect transistors N4 and N8. A gate terminal of the transistor N4 is coupled to a gate terminal and a drain terminal of the transistor N8. A drain terminal of the transistor N4 is connected to the gate terminal of the transistor N3, and a source terminal of the transistor N4 is connected to the source terminal of the transistor N3. A source terminal of the transistor N8 is connected to the input E of the current mirror SP.

The rise accelerator AB comprises, in addition to FIG. 1, an n-channel field effect transistor N11 as well as a p-channel field effect transistor P2, which realizes the function of the acceleration switch S2 from FIG. 1. A gate terminal of the transistor P2 is connected to the control input S, a source terminal of the transistor P2 is connected to the current source Q2, and a drain terminal of the transistor P2 is connected to a drain terminal of the transistor N11. A gate terminal of the transistor N11 is connected to the drain terminals of the transistors N3 and N4. A source terminal of the transistor N11 is connected to the input E of the current mirror SP. The current mirror SP comprises the input transistor N7, the output transistor N9, as well as an n-channel field effect transistor N10 that realizes the function of the discharge switch S4 from FIG. 1. A gate terminal of the transistor N10 is coupled to the control input S, a drain terminal of the transistor N10 is coupled to the input E of the current mirror SP and a source terminal of the transistor N10 is connected to the second terminal K2 of the circuit. The current I is provided at the output A of the circuit.

The currents as well as the transistors N5 and N7 are dimensioned as described in FIG. 1. In addition, the transistors N3 and N8 are dimensioned equally.

To switch on the current I, the control signal ST at the control input S is placed at the potential of the second terminal K2 of the circuit, i.e., at ground potential, for example. Thereby the transistors P0, P1 and P2 are shifted into a conductive state and the transistors N6 and N10 into a blocking state. The supply current I1, the reference current I3 and the acceleration current I2 are switched on. By means of the transistor N5, the reference current I3 forms a rise ramp for the reference voltage U2. As long as a sum of the reference voltage U2 and a threshold voltage of the transistor N4 is greater than a sum of the master reference voltage U1 and a drain-source voltage of the transistor N8, the transistor N4 blocks. The control voltage U3 is thus a sum of the reference voltage U2 and a drain-source voltage of the transistor N3. Consequently, the transistor N11 is in the conductive state and the acceleration current I2 is applied to the input E of the current mirror SP in addition to the supply current I1.

As soon as the sum of the master reference voltage U1 and the drain-source voltage of the transistor N8 reaches the sum of the reference voltage U2 and the threshold voltage of the transistor N4, the transistor N4 becomes conductive and short-circuits the transistor N3 operated as a diode. Thus the control voltage U3 returns to the value of the reference voltage U2. The transistor N11 blocks and the value of the acceleration current I2 additionally supplied to the input E of the current mirror SP goes to zero.

To turn off the current I, the control signal ST at the control input S is placed at the supply potential present at the first terminal K1 of the circuit. Thereby the transistors P0, P1 and P2 are shifted into a blocking state and the transistors N6 and N10 into a conductive state. The gate terminals of the transistors N11 and N9 are discharged. An edge steepness that can be achieved here is determined by the respective capacitances of the transistors N7 and N9, as well as by a resistance of the transistor N10.

The slew rate of the current I realized in this circuit is advantageously independent of the final value of the current I, i.e. independent of the set current mirror ratio. The rise rate can be adjusted via the reference voltage U2 according to the requirements of the application.

The circuit arrangement can be used particularly advantageously in the field of CMOS circuits. If 0.35 μm technology is used, for example, slew rates of 5 mA/ns can be achieved. The slew rate remains constant over a large temperature and voltage range. An overshoot of the current I is advantageously held in a minimal range. Because equally dimensioned transistors are used, variations in the manufacturing process of the transistors have only a very slight influence on the circuit's behavior. The advantages of the circuit become particularly clear in high-frequency applications that require a high precision. For example, periodically switching the current I on and/or off, for brightness control of diodes by means of a high-resolution pulse width-modulated signal can be realized with a slew rate matched to the frequency of the pulse width-modulated signal.

Figure 3:
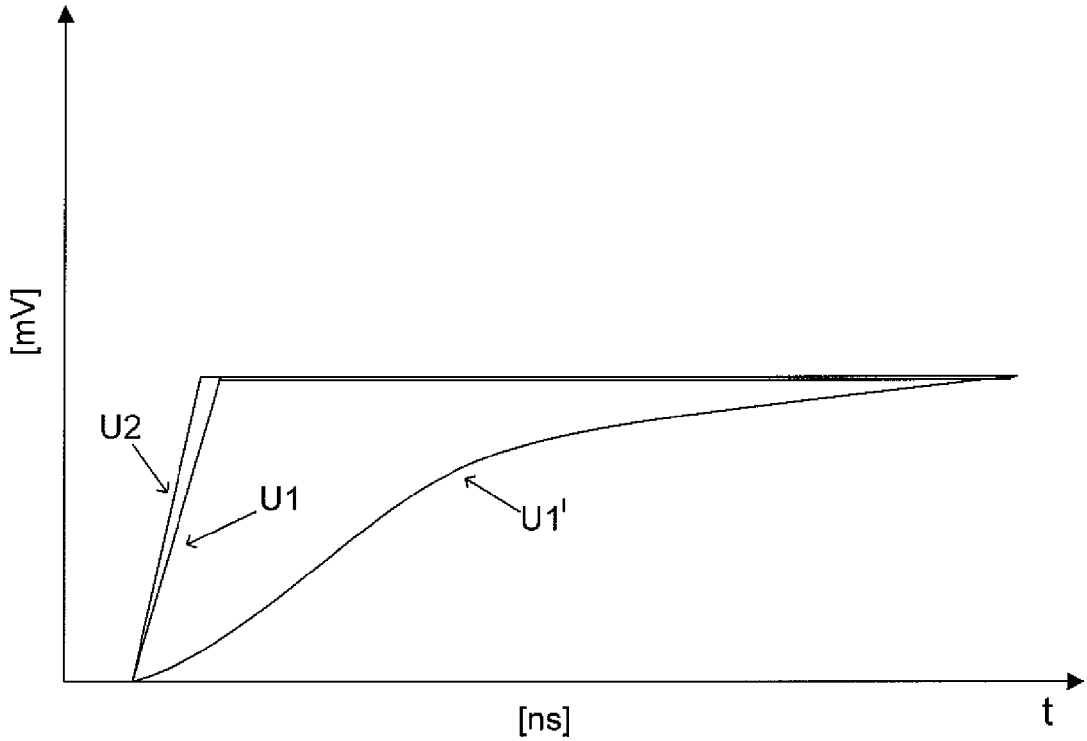
FIG. 3 shows a diagram with exemplary voltage curves.

FIG. 3 shows a diagram with exemplary voltage curves. The abscissa represents a time t in ns, the ordinate represents voltage values in mV. The curve of the reference voltage U2 and the curve of the master reference voltage U1 are shown. It is clearly recognizable that the curve of the master reference voltage U1 follows the curve of the reference voltage U2. The rising edge of the reference voltage U2 is impressed on the master reference voltage U1. In comparison to this, a curve of a master reference voltage U1' is shown that is achieved with the conventional arrangement of a current mirror and a current source described in the beginning. The edge of the voltage curve U1' is markedly flatter and undefined.

Figure 4:
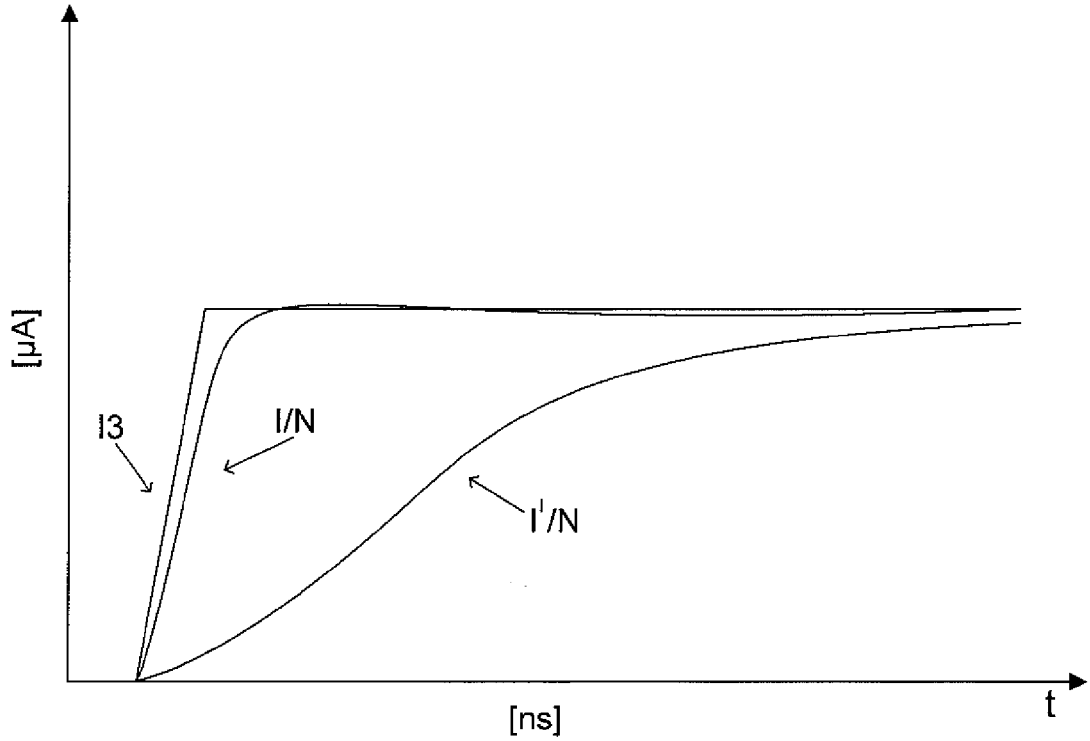
FIG. 4 shows a diagram with exemplary current curves.

FIG. 4 shows a diagram with exemplary current curves. The abscissa again represents a time t in ns, the ordinate represents current values in mA. The curves of the reference current I3 and the current I, divided by a set current mirror ratio N, are shown. It is clearly recognizable that the curve of the current I follows the curve of the reference current I3. Overshooting of the current I is minimal. The curve of a current divided by the current mirror ratio N is shown for comparison. This curve can be achieved with the conventional arrangement of a current mirror and a current source described in the beginning. The flat and undefined rising edge curve of the current I' is clearly recognizable.

FIGS. 3 and 4 clearly demonstrate that a defined switch-on behavior of current mirror-based current drivers can be achieved with the above-described current mirror arrangement.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A current mirror arrangement comprising:

a switchable, adjustable current source for providing an impression current;

a current mirror with an input for feeding in the impression current and an output for providing a current; and a step-up generator that is coupled to the current mirror in such a manner that the current is switched on with an adjustable slew rate, wherein the current mirror is coupled to the step-up generator via a comparator to provide a control voltage and the control voltage provided by the comparator is a function of a difference between a reference voltage and a master reference voltage.

2. The current mirror arrangement according to claim 1, wherein the switchable, adjustable current source comprises a first current source switchable by a power-on switch for providing a supply current, and a second, adjustable current source switchable by an acceleration switch for supplying an acceleration current, so that the impression current is formed as a sum of the supply current and the acceleration current.

3. The current mirror arrangement according to claim 1, wherein the step-up generator comprises a series circuit, having a switchable third current source, a rise switch and a transistor, the series circuit being connected between a first terminal and a second terminal of the current mirror arrangement, wherein a voltage can be tapped between a first and a second terminal of the transistor as the reference voltage.

4. The current mirror arrangement according to claim 3, wherein the current mirror comprises an input transistor connected between its input and the second terminal of the current mirror arrangement, as well as an output transistor, wherein a voltage between a first and a second terminal of the input transistor forms the master reference voltage.

5. The current mirror arrangement according to claim 4, wherein the current mirror has a discharge switch connected between the input of the current mirror and the second terminal of the current mirror arrangement.

6. The current mirror arrangement according to claim 2, wherein the acceleration current provided by the second current source is adjustable relative to the control voltage.

7. The current mirror arrangement according to claim 2, wherein the step-up generator comprises a series circuit, having a switchable third current source, a rise switch and a transistor, the series circuit being connected between a first terminal and a second terminal of the current mirror arrangement, wherein a voltage can be tapped between a first and a second terminal of the transistor as a reference voltage, and wherein the current sources are dimensioned such that a reference current emitted by the third current source is equal to the supply current, and the maximum adjustable acceleration current is larger than the supply current.

8. The current mirror arrangement according to claim 2, wherein the step-up generator comprises a series circuit, having a switchable third current source, a rise switch and a transistor, the series circuit being connected between a first terminal and a second terminal of the current mirror arrangement, wherein a voltage can be tapped between a first and a second terminal of the transistor as a reference voltage, wherein the current mirror has a discharge switch connected between the input of the current mirror and the second terminal of the current mirror arrangement, and wherein a control unit causes the current to be switched on by a simultaneous closing of the power-on switch, the rise switch and the acceleration switch, respectively, and a simultaneous opening of the discharge switch.

9. The current mirror arrangement according to claim 2, wherein the step-up generator comprises a series circuit, having a switchable third current source, a rise switch and a transistor, the series circuit being connected between a first terminal and a second terminal of the current mirror arrangement, wherein a voltage can be tapped between a first and a second terminal of the transistor as a reference voltage, wherein the current mirror has a discharge switch connected between the input of the current mirror and the second terminal of the current mirror arrangement, and wherein the control unit causes the current to be switched off by a closure of the discharge switch and a simultaneous opening of the power-on switch, the rise switch and the acceleration switch, respectively.

10. The current mirror arrangement according to claim 3, wherein the current mirror comprises an input transistor connected between its input and the second terminal of the current mirror arrangement, as well as an output transistor, wherein a voltage between a first and a second terminal of the input transistor forms the master reference voltage, and wherein the input transistor of the current mirror and the transistor of the step-up generator are dimensioned equally.

11. The current mirror arrangement according to claim 2, wherein the current can be adjusted with a specifiable current mirror ratio relative to the supply current.

12. A method for switching on a current comprising:

feeding in a supply current;

impressing a rising edge relative to a curve of a reference voltage;

providing a control voltage as a function of a difference between the reference voltage and a master reference voltage; and providing a current as a function of the supply current and with the impressed rising edge.

13. The method according to claim 12, wherein a final value of the current can be adjusted with a specifiable current mirror ratio relative to the supply current.

14. The method according to claim 12, wherein the impressed rising edge is adjustable by means of the reference voltage.

* * * * *